US008286712B2

(12) United States Patent
Wilson

(10) Patent No.: US 8,286,712 B2
(45) Date of Patent: Oct. 16, 2012

(54) DEPLOYING AN ELECTRICALLY-ACTIVATED TOOL INTO A SUBSEA WELL

(75) Inventor: Steve Wilson, Aberdeen (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 25 days.

(21) Appl. No.: 12/941,695

(22) Filed: Nov. 8, 2010

(65) Prior Publication Data

US 2011/0114327 A1 May 19, 2011

Related U.S. Application Data

(60) Provisional application No. 61/260,281, filed on Nov. 11, 2009.

(51) Int. Cl.
*E21B 7/12* (2006.01)

(52) U.S. Cl. ..... 166/338; 166/368; 166/365; 166/360

(58) Field of Classification Search ..... 166/338, 166/368, 365, 360, 54.1, 62, 68, 241.2; 417/1, 417/16, 17
See application file for complete search history.

(56) References Cited

U.S. PATENT DOCUMENTS

| | | | | |
|---|---|---|---|---|
| 6,328,111 | B1 | 12/2001 | Bearden et al. | |
| 6,688,392 | B2 | 2/2004 | Shaw | |
| 6,691,775 | B2 * | 2/2004 | Headworth | 166/77.2 |
| 6,776,230 | B2 | 8/2004 | Collie et al. | |
| 6,956,344 | B2 * | 10/2005 | Robertson et al. | 318/538 |
| 6,971,373 | B2 * | 12/2005 | Mudway et al. | 123/497 |
| 7,165,619 | B2 * | 1/2007 | Fox et al. | 166/343 |
| 7,640,993 | B2 * | 1/2010 | Head | 166/385 |
| 7,775,275 | B2 | 8/2010 | Patel | |
| 2002/0040782 | A1 * | 4/2002 | Rytlewski et al. | 166/341 |
| 2005/0095138 | A1 * | 5/2005 | Robertson et al. | 417/16 |
| 2006/0243450 | A1 * | 11/2006 | Head | 166/369 |
| 2007/0227741 | A1 * | 10/2007 | Lovell et al. | 166/380 |
| 2007/0289747 | A1 | 12/2007 | Shaw et al. | |

FOREIGN PATENT DOCUMENTS

GB 2422168 B 8/2007

* cited by examiner

*Primary Examiner* — Thomas Beach
*Assistant Examiner* — Aaron Lembo
(74) *Attorney, Agent, or Firm* — Jim Patterson

(57) ABSTRACT

An apparatus for use with a subsea well includes a lubricator configured to attach to subsea wellhead equipment, an electrically-activated tool, and a coiled tubing attached to the electrically-activated tool. The electrically-activated tool is initially provided in the lubricator to allow for deployment of the electrically-activated tool on the coiled tubing into the subsea well. Multiple tools may be deployed independently from within the lubricator to latch into a concentric electrical connector within the well which may also act as a switch. A concentric electrical connector will permit the passage of a tool through the body of the connector retaining full bore access when the tool is withdrawn.

17 Claims, 4 Drawing Sheets

DEPLOYING AN ELECTRICALLY-ACTIVATED TOOL INTO A SUBSEA WELL

CROSS-REFERENCE TO RELATED APPLICATIONS

The present document is based on and claims priority to U.S. Provisional Application Ser. No. 61/260/281, filed Nov. 11, 2009.

BACKGROUND

To produce fluids (such as hydrocarbons) through a well, various equipment are deployed into the well. Examples of such equipment include completion equipment such as casing, production tubing, and other equipment. Once installed in the well, the equipment allows for production of fluids from a reservoir surrounding the well to the surface.

Certain wells have insufficient reservoir pressure to propel fluids to the surface. A reservoir with a relatively low pressure may not be able to produce sufficient fluid flow to overcome various opposing forces, including forces applied by the back pressure of a column of water, frictional forces of conduits, and other forces. To produce fluids from reservoirs having limited reservoir pressures, artificial lift equipment can be deployed. Examples of artificial lift equipment include pumps such as electrical submersible pumps (ESPs) or other types of pumps.

Installing an ESP or other type of intervention equipment into a well can be time consuming and expensive. This is particularly the case with subsea wells, since well operators would have to transport the intervention equipment by marine vessels to the subsea well sites. Subsea well operators are often reluctant to perform ESP installation in subsea wells due to the cost of installation, and also due to the possibility that failed ESP equipment may have to be retrieved and replaced with replacement ESP equipment.

SUMMARY

In general, according to some embodiments, a method or apparatus is provided to allow for a more efficient way of deploying an electrically-activated tool (such as an electrical submersible pump) into a subsea well. In one embodiment, an assembly for use in the subsea well includes a lubricator (configured to attach to subsea wellhead equipment), an electrically-activated tool, and a coiled tubing attached to the electrically-activated tool. The electrically-activated tool is initially provided in the lubricator. The electrically-activated tool is then lowered on the coiled tubing from the lubricator into the subsea well.

Other or alternative features will become apparent from the following description, from the drawings, and from the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments are possible.

As used here, the terms "above" and "below"; "up" and "down"; "upper" and "lower"; "upwardly" and "downwardly"; and other like terms indicating relative positions above or below a given point or element are used in this description to more clearly describe some embodiments of the invention. However, when applied to equipment and methods for use in wells that are deviated or horizontal, such terms may refer to a left to right, right to left, or diagonal relationship as appropriate.

In accordance with some embodiments, an efficient technique of deploying an electrically-activated tool in a subsea well involves use of a lubricator that has an inner chamber to initially contain the electrically-activated tool. The lubricator is configured to be attached to subsea wellhead equipment. As used here, the term "subsea well" refers to any well that is located under a surface in a marine environment. The electrically-activated tool is deployed into the subsea well by use of coiled tubing. In some embodiments, the coiled tubing is provided without an electrical cable, such that the coiled tubing is used merely as a deployment structure, which reduces the complexity and cost of the coiled tubing.

To provide electrical power to the electrically-activated tool when the coiled tubing does not include an electrical cable, an electrical connection mechanism is provided on the tool that is used to mate with a corresponding electrical connection sub located on equipment installed in the subsea well. In some embodiments, the electrical connection mechanism on the tool is a wet-mate electrical connection mechanism to allow electrical contact to be made in the subsea well in the presence of fluids.

Figure 1:
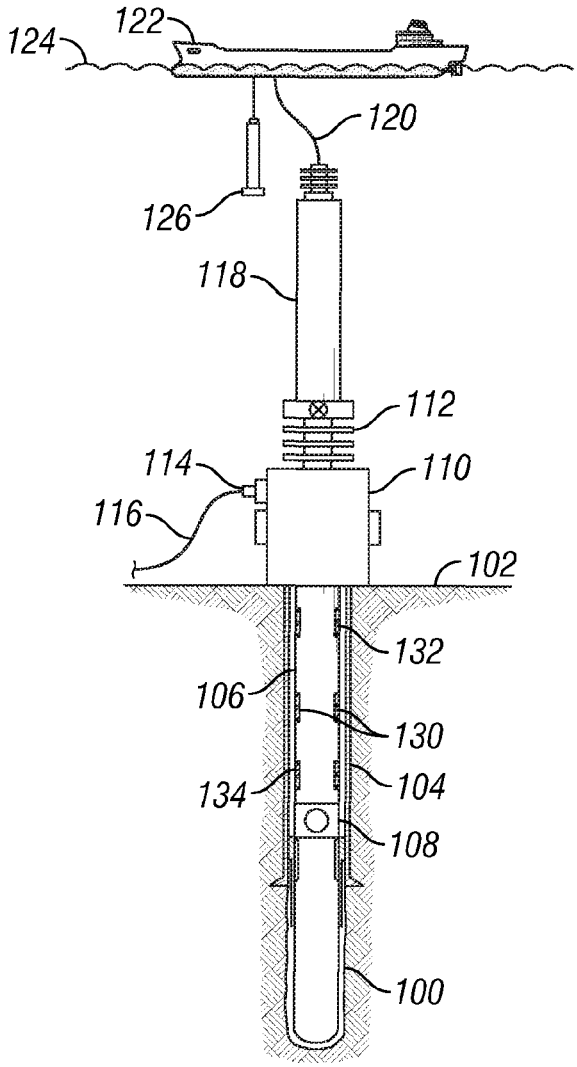
FIG. 1 is a schematic diagram of a marine arrangement for deploying an electrical submersible pump (ESP) into a subsea well, according to an embodiment.

FIG. 1 illustrates an example of a marine arrangement that has a subsea well 100 extending below a sea bottom surface 102. The subsea well 100 is lined with casing 104. In addition, a production tubing 106 is installed in the subsea well 100. Fluids from a reservoir surrounding the subsea well 100 flow into the subsea well 100 and up the production tubing 106 to the surface. Although reference is made to production of fluids, it is noted that in alternative implementations, equipment can be provided for injection of fluids through the subsea well 100 into the surrounding reservoir.

In the example shown in FIG. 1, a safety valve 108 is deployed at the lower end of the production tubing 106. The safety valve 108 is used to shut in the well in case of equipment failure. Although a specific embodiment is shown in FIG. 1, it is noted that in alternative embodiments, other or additional components can be provided in the subsea well 100.

At the sea bottom surface 102, wellhead equipment 110 is provided. The wellhead equipment 110 includes a blow-out preventer (BOP) 112 that is used to seal off the subsea well 100 at the surface 102.

A high-voltage connector 114 is provided on the wellhead equipment 110. The high voltage connector 114 is connected to an electrical cable 116 to allow for provision of electrical power to the wellhead equipment 110 as well as to equipment in the subsea well 100. The electrical cable 116 runs from the wellhead equipment to a remote power source, which can be located underwater, on a sea platform, or on a marine vessel.

In accordance with some embodiments, a lubricator 118 is attached to the BOP 112, where the lubricator 118 has an internal chamber that initially contains the electrically-activated tool that is to be deployed into the subsea well 100. Although the example implementation shows the lubricator 118 as being attachable to the BOP 112, it is noted that the lubricator 118 can be attached to other structures of the wellhead equipment 110 in other implementations.

The upper end of the lubricator 118 is attached to a compliant guide 120, which is a flexible tubing extending from a marine vessel 122 located at the sea surface 124. The compliant guide 120 has an inner bore in which the coiled tubing for deploying the electrically-activated tool into the subsea well 100 is located.

Figure 2:
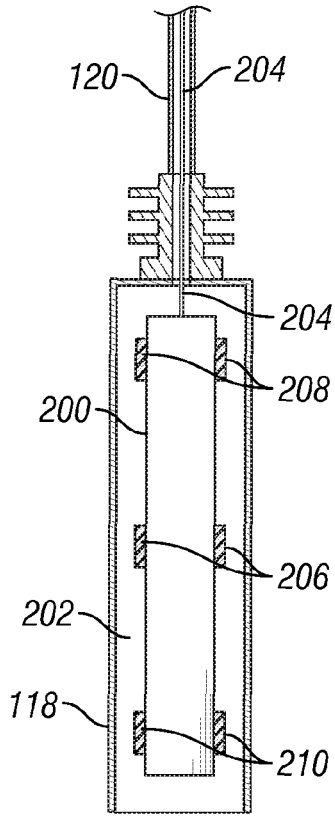
FIG. 2 illustrates an assembly that includes a lubricator, an ESP, a compliant guide, and a coiled tubing, according to an embodiment.

FIG. 2 is a schematic diagram that shows an electrically-activated tool 200 located inside an inner chamber 202 of the lubricator 118. Also, FIG. 2 shows the electrically-activated tool 200 being attached to a coiled tubing 204 that extends through the inner bore of the compliant guide 120.

In operation, an assembly that includes the lubricator 118 and the electrically-activated tool 200 contained inside the lubricator 118 is deployed from the marine vessel 122 to the well site shown in FIG. 1. The lubricator 118 is then attached to the BOP 112. In addition, the compliant guide 120 is attached to the lubricator 118, which allows the coiled tubing 204 to attach to the electrically-activated tool 200. The electrically-activated tool 200 is then lowered into the subsea well 100 on the coiled tubing 204 through the wellhead equipment 110.

Once lowered into the subsea well 100, the electrically-activated tool 200 is positioned inside the production tubing 106. In some embodiments, the electrically-activated tool 200 is a pump such as an electrical submersible pump (ESP). In the ensuing discussion, reference is made to an ESP—however, in alternative embodiments, other types of electrically-activated tools can be used.

Once the ESP 200 is positioned in the production tubing 106, the ESP 200 can be activated to start pumping fluids drawn into the subsea well 100 to the surface. Fluids flowed to the wellhead equipment 110 are directed into conduits (not shown) to carry the fluids to another location, such as to a sea surface platform or marine vessel, or to an underwater storage facility.

Over the life of the ESP 200, it is possible that the ESP 200 may fail, such that the ESP 200 would have to be replaced. FIG. 1 further shows another assembly including a replacement lubricator 126 and a replacement ESP contained in the replacement lubricator 126 that can be lowered from the marine vessel 122 to replace the existing lubricator 118 and ESP 200. If a fault or failure of ESP 200 is detected, the ESP 200 is retrieved from the subsea well 100 into the lubricator 118. The lubricator 118 (containing the ESP 200) can then be detached from the BOP 112 and set to the side, and the replacement lubricator 126 (which contains the replacement ESP) is then attached to the BOP 112 in place of the lubricator 118. The lubricator 118 and ESP 200 can then be retrieved to the marine vessel 122 for repair or disposal.

Next, the compliant guide 120 is attached to the replacement lubricator 126. The coiled tubing 204 inside the compliant guide 120 is then attached to the replacement ESP, and the coiled tubing 204 can be used to lower the replacement ESP into the subsea well 100.

In this manner, a relatively convenient and flexible mechanism is provided for replacement of an ESP or other type of electrically-activated tool that has been deployed into the subsea well 100.

As noted above, the coiled tubing 204 can be provided without an electrical cable to reduce the complexity and cost of the coiled tubing. In such an embodiment, power is not provided through the coiled tubing 204, but rather is provided by an alternative mechanism. FIG. 1 further shows that the production tubing 106, which is positioned downhole in the subsea well 100, is provided with a connection sub 130 that is configured to make a connection (electrical connection and optionally a hydraulic connection) with a corresponding connection mechanism 206 on the ESP 200. Also, the production tubing 106 has an internal upper seal bore 132 and a lower seal bore 134 for sealing engagement with corresponding upper and lower sealing elements 208 and 210 provided on the ESP 200.

Thus, once the ESP 200 is positioned at the correct depth inside the production tubing 106, the connection mechanism 206 on the ESP 200 engages with the connection sub 130 of the production tubing 106. Also, the sealing elements 208 and 210 sealingly engage the corresponding upper and lower seal bores 132 and 134 such that proper fluid seals are established between the ESP 200 and the inner wall of the production tubing 106 to allow for proper operation of the ESP 200.

Figure 3:
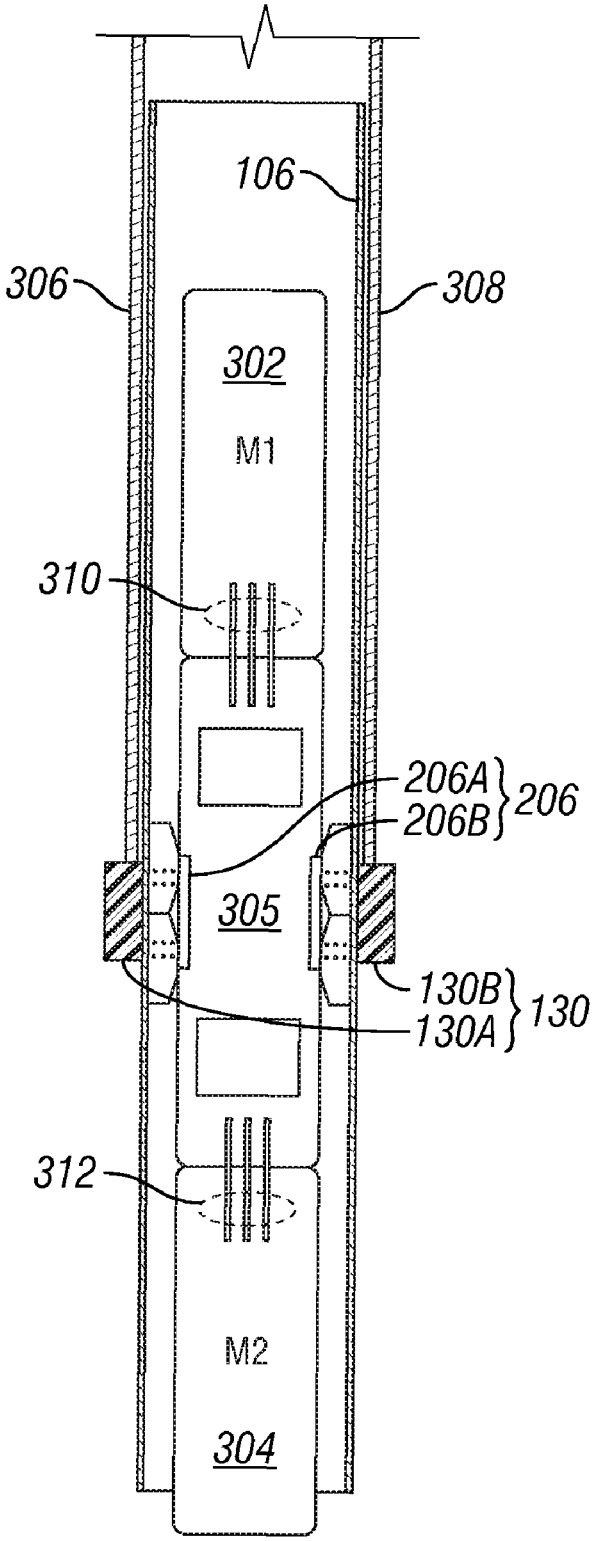
FIG. 3 is a schematic diagram of a portion of a production tubing and an ESP, according to an embodiment.

FIG. 3 illustrates an enlarged view of portions of the production tubing 106 and the ESP 200. In some embodiments, the ESP 200 is provided with two motors 302 and 304 to provide redundancy. One of the motors 304 can be used for operating the ESP 322 until a fault or failure is detected, at which point the other of the motors 302, is selected for operating the ESP 320.

FIG. 3 further shows details of the connection sub 130 (on the production tubing 106) for making connection with the corresponding connection mechanism 206 on the ESP 200. The connection sub 130 includes an electrical connector assembly 130A for making a wet electrical connection with a corresponding electrical connector 206A that is part of the connection mechanism 206 on the ESP 200. In addition, in some embodiments, the connection sub 130 further includes a hydraulic connector assembly 130B for connection to a corresponding hydraulic connector 206B that is part of the connection mechanism 206 on the ESP 200.

The electrical connector assembly 130A is connected to an electrical cable 306 that runs outside the production tubing 106, and the hydraulic connector assembly 130B is connected to a hydraulic control line 308 that also runs outside the production tubing 106. Although the connection sub 130 and the connection mechanism 206 are depicted as including both electrical and hydraulic connectors, it is noted that in alternative embodiments, the hydraulic connectors can be omitted.

In the ESP 200, a switch sub 305 is provided between the upper motor 302 and the lower motor 304. The switch sub 305 is used to selectively activate one of the motors 302 and 304. In some embodiments, the selective switching between the upper motor 302 and the lower motor 304 is accomplished by using a hydraulic mechanism actuated by hydraulic pressure provided through the hydraulic control line 308. In alternative embodiments, instead of using a hydraulic mechanism to switch between the upper and lower motors 302 and 304, an electrically-activated switch mechanism in the switch sub 305 can be used instead.

The upper motor 302 is connected to the switch sub 305 by a set 310 of three electrical lines that carry the three phases of high-voltage power. This connection may be a Wet Mate connection made between 305 and 302 in the wellbore 106. This would facilitate the separate installation of lower pump section 600 from upper pump section 602. Similarly, a set 312 of three electrical lines connect the lower motor 304 to the switch sub 305. Power is provided to a selected one of the motors 302 and 304 over a respective set 310 and 312 of electrical lines depending on which of the motors has been selected by the switch sub 304 for activation.

In accordance with some embodiments, the hydraulic control line 308 provides hydraulic pressure to allow for selective switching between the upper and lower motors 302 and 304. If the well operator detects that the upper motor 302 has failed, for example, then hydraulic pressure can be applied through the hydraulic control line 308 to cause the switch sub 305 to switch to the lower motor 304 (such that power from the electric cable 306 is provided through the switch sub 305 to the lower motor 304 through the set 312 of electrical lines). Conversely, a switch from the lower motor 304 to the upper motor 306 can be performed if it is detected that the lower motor 304 is faulty or has failed.

Figure 4:
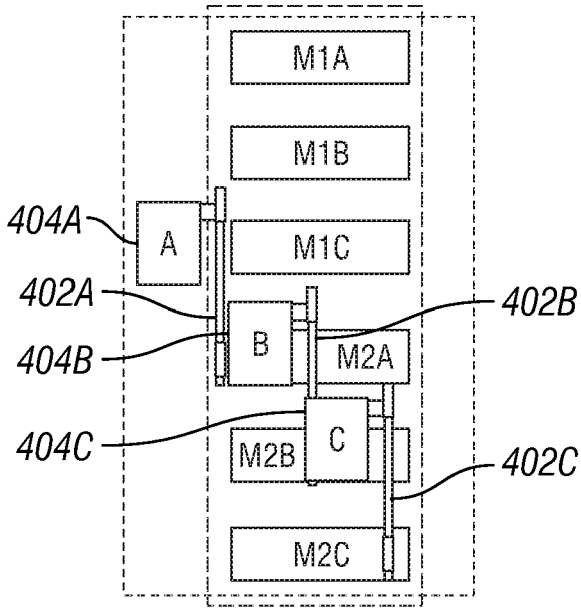
FIGS. 4 and 5 illustrate components in a switch sub of the ESP, in accordance with an embodiment.
Figure 5:
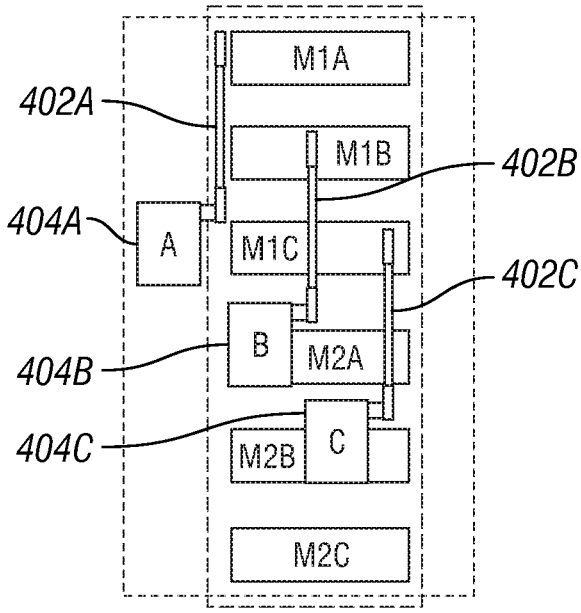

FIGS. 4 and 5 illustrate components within the switch sub 305 that are used for switching between the upper motor 302 and the lower motor 304. Two sets of contact terminals are shown in FIG. 4: a first set that includes contact terminals M1A, M1B, and M1C; and a second set that includes contact terminals M2A, M2B, and M2C. The first set of contact terminals M1A, M1B, M1C are connected to the corresponding electrical lines of the first set 310 (shown in FIG. 3). Similarly, the second set of contact terminals M2A, M2B, and M2C are connected to the second set 312 of electrical lines (shown in FIG. 3).

FIG. 4 also shows a set of movable electrical connection pins 402A, 402B, and 402C (which can be part of a hydraulically movable sleeve, for example), which are designed to electrically contact either the first set of contact terminals M1A, M1B, M1C, or the second set of contact terminals M2A, M2B, M2C, depending upon the positions of the corresponding connection pins 402A, 402B, and 402C. In FIG. 4, the connection pins 402A, 402B, 402C are shown in a lower position to make electrical contact between termination points 404A, 404B, and 404C and the corresponding contact terminals M2A, M2B, and M2C. The termination points 404A, 404B, and 404C are electrically connected to the three-phase power voltages provided by the electrical cable 306.

In the position of FIG. 4, power from the electrical cable 306 (FIG. 3) is provided to the contact terminals M1A, M1B, and M1C. This in turn causes power to be provided to the second set 312 of electrical lines (FIG. 3) to provide power to the lower motor 304.

On the other hand, as shown in FIG. 5, the movable connection pins have been moved upwardly (by hydraulic actuation using the hydraulic control line 308 and hydraulic connectors 130B and 206B of FIG. 3) to their upper positions for making electrical contact with the first set of contact terminals M1A, M1B, and M1C. In the position of FIG. 5, electrical power is provided from the electrical cable 306 (FIG. 3) and through the termination points 404A, 404B, 404C, contact terminals M1A, M1B, M1C, and first set 310 (FIG. 3) of electrical lines to the upper motor 302.

Figure 6:
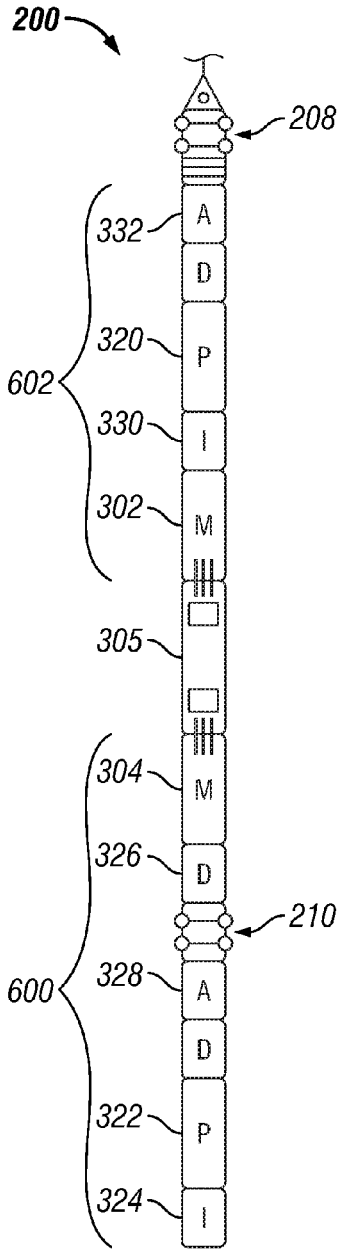
FIGS. 6-8 schematically illustrate components of an ESP according to an embodiment.

FIG. 6 shows the ESP 200 according to one example embodiment in greater detail. Although a specific arrangement of components of the ESP 200 is shown in FIG. 6, it is noted that in an alternative embodiment, a different arrangement of components can be employed in the ESP 200. In addition to the switch sub 305 and upper and lower motors 302 and 304, the ESP 200 also includes an upper pump 320 that is powered by the upper motor 302, and a lower pump 322 that is powered by the lower motor 304. The ESP 200 includes a lower pump section 600 (which includes the lower motor 304 and lower pump 322) and an upper pump section 602 (which includes the upper motor 302 and upper pump 320).

Figure 8:
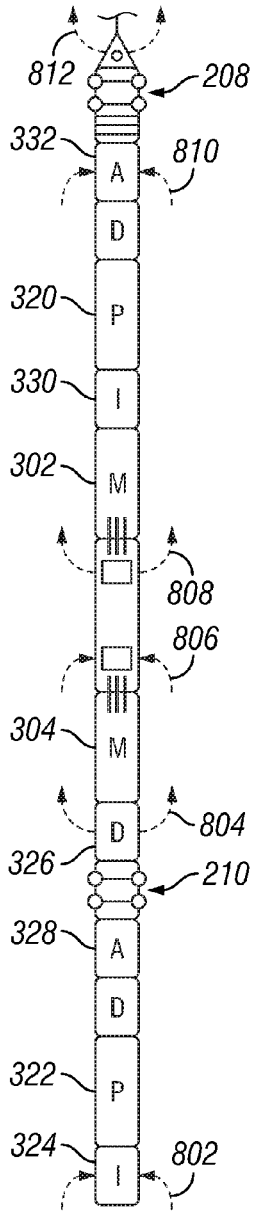

Referring further to FIG. 8, it is assumed that the switch sub 305 has been actuated to activate the lower motor 304 (such that the lower pump section 600 is active and the upper pump section 602 is inactive). In the lower pump section 600, a pump intake 324 is configured to accept input fluid flow (arrows 802 in FIG. 8) into the lower pump section 600. The lower pump 322 causes fluid to flow upwardly past the sealing elements 210 for discharge through a lower pump discharge 326 (arrows 804). The fluid that is discharged from the lower pump discharge 326 is flowed further upwardly, as shown by arrows 806, 808, and 810, and 812 in FIG. 8.

Arrows 806 indicate that the fluid output from the lower pump discharge 326 is flowed into a lower portion of the switch sub 305. The fluid then exits the upper portion of the switch sub 305 (as indicated by arrows 808) and the fluid is further received in an upper autoflow sub (arrows 810). Fluid then exits at the top of the ESP 200 (arrows 812) above the upper sealing elements 208.

Figure 7:
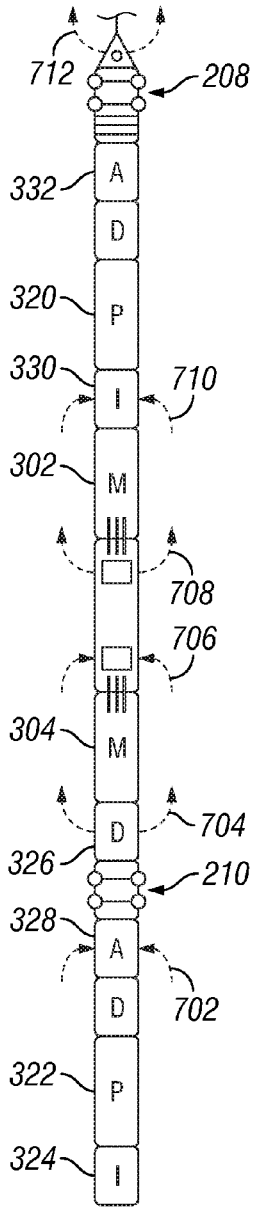

FIG. 7 shows operation of the ESP 200 when the upper motor 302 and upper pump 320 are operating, and the lower motor 304 and lower pump 322 are inactive. Fluid flows into a lower autoflow sub 328 (arrows 702), which then exits through the lower pump discharge 326 (arrows 704). The fluid then continues into the lower portion of the switch sub 305 (arrows 706), and out of the upper portion of the switch sub 305 (arrows 708). The fluid that flows out of the switch sub 305 is then directed through the upper pump intake 330 (arrows 710), which then is pumped out of the top of the ESP 200 (arrow 712).

The ESP 200 depicted in FIGS. 6-8 further include other components, including another discharge sub (represented as "D") and another autoflow sub (represented as "A"), which are used for fluid flow in other operations of the ESP 200.

Although the embodiments discussed herein employ a dual ESP system that has two pumps, it is noted that in an alternative embodiment, a single ESP system can be used that includes just a single pump. In addition the dual ESP system may be assembled in the production tubing 106 separately. Lower pump system 600 may be installed locating the switch sub 305 to connection mechanism 130 and sealing element 210 to seal bore 134. Upper pump assembly 602 may then be installed locating upper motor 302 to switch sub 305 and sealing element 208 to seal sub 132. Such an arrangement facilitates a small lubricator 118. In addition, instead of using a wet connect mechanism, alternative embodiments can employ other types of electrical connection mechanisms, such as inductive coupler mechanisms.

While the invention has been disclosed with respect to a limited number of embodiments, those skilled in the art, having the benefit of this disclosure, will appreciate numerous modifications and variations therefrom. It is intended that the appended claims cover such modifications and variations as fall within the true spirit and scope of the invention.

What is claimed is:

1. An apparatus for use with a subsea well, comprising:

a lubricator configured to attach to subsea wellhead equipment;

an electrical submersible pump that comprises at least two motors in at least two pump sections to provide redundancy wherein the at least two pump sections sit into the subsea well to connect together in the subsea well;

a mechanism to selectively activate one of the at least two motors for operation of the electrical submersible pump; and a coiled tubing attached to the electrical submersible pump, wherein the electrical submersible pump is initially provided in the lubricator to allow for deployment of the electrical submersible pump on the coiled tubing into the subsea well.

2. The apparatus of claim 1, wherein the mechanism comprises a hydraulically-actuatable mechanism to move an electrical contact assembly to electrically connect one of the at least two motors.

3. The apparatus of claim 1, wherein the electrical submersible pump has an electrical connection mechanism to electrically contact a mating electrical connection sub in the subsea well.

4. The apparatus of claim 3, wherein the electrical connection mechanism is a wet electrical connection mechanism.

5. The apparatus of claim 3, wherein the electrical submersible pump further comprises a first hydraulic connector to connect a mating hydraulic connector sub in the subsea well.

6. The apparatus of claim 3, wherein the electrical connection sub is part of a production tubing in the subsea well.

7. The apparatus of claim 1, wherein the lubricator is detachable from the subsea wellhead equipment to allow a replacement lubricator with a replacement electrical submersible pump to attach to the subsea wellhead equipment.

8. The apparatus of claim 1, further comprising: a compliant guide for attachment to the lubricator, wherein the coiled tubing is contained in the compliant guide, and wherein the compliant guide is configured to connect to a marine vessel.

9. A method for use with a subsea well, comprising:

attaching a lubricator to subsea wellhead equipment, wherein the lubricator has an internal chamber containing an electrical submersible pump that comprises at least two motors in at least two pump sections to provide redundancy;

attaching a coiled tubing to the electrical submersible pump;

lowering the electrical submersible pump from the lubricator through the subsea wellhead equipment into the subsea well;

connecting together the at least two pump sections in the subsea well; and selectively activating one of the at least two motors for operation of the electrical submersible pump in the subsea well.

10. The method of claim 9, further comprising: attaching a compliant guide to the lubricator, wherein the coiled tubing is provided inside the compliant guide, and wherein the compliant guide is attached to a marine vessel.

11. The method of claim 9, further comprising: making electrical connection between the electrical submersible pump to a connection sub that is part of equipment downhole inside the subsea well.

12. The method of claim 11, wherein the electrical submersible pump has an electrical connection mechanism to make a wet electrical contact to the connection sub.

13. The method of claim 11, wherein the coiled tubing is provided without an electrical cable.

14. The method of claim 11, wherein the electrical submersible pump includes plural electrically-activatable components, and wherein the electrical submersible pump further comprises a switch sub to selectively switch between or among the electrically-activatable components.

15. The method of claim 14, wherein the switch sub comprises a hydraulically-actuatable mechanism to switch between or among the plural electrically-activatable components.

16. A system for use with a subsea well, comprising:

subsea wellhead equipment for use with the subsea well;

a lubricator attached to the subsea wellhead equipment;

an electrical submersible pump initially provided in the lubricator wherein the electrical submersible pump comprises at least two motors in at least two pump sections to provide redundancy;

a mechanism to selectively activate one of the at least two motors for operation of the electrical submersible pump; and a coiled tubing attached to the electrical submersible pump, wherein the coiled tubing is configured to lower the electrical submersible pump from the lubricator into the subsea well wherein the at least two pump sections sit into the subsea well to connect together in the subsea well.

17. The system of claim 16, wherein the lubricator is detachable from the subsea wellhead equipment, such that a replacement lubricator with a replacement electrical submersible pump can be attached to the subsea wellhead equipment.

* * * * *